US009441639B2

(12) United States Patent
Hafner

(10) Patent No.: US 9,441,639 B2
(45) Date of Patent: Sep. 13, 2016

(54) COMPRESSOR ROTOR HEAT SHIELD

(71) Applicant: General Electric Company, Schenectady, NY (US)

(72) Inventor: Matthew Troy Hafner, Honea Path, SC (US)

(73) Assignee: General Electric Company, Schenectady, NY (US)

( * ) Notice: Subject to any disclaimer, the term of this patent is extended or adjusted under 35 U.S.C. 154(b) by 687 days.

(21) Appl. No.: 13/892,414

(22) Filed: May 13, 2013

(65) Prior Publication Data

US 2014/0334929 A1 Nov. 13, 2014

(51) Int. Cl.
*F04D 29/58* (2006.01)
*F04D 29/32* (2006.01)

(52) U.S. Cl.
CPC ..... *F04D 29/5853* (2013.01); *F04D 29/322* (2013.01)

(58) Field of Classification Search
CPC .... F04D 29/5853; F04D 29/322; F01D 5/08; F01D 11/006; F01D 25/246; F01D 11/001; F01D 11/005; F01D 11/008; F01D 5/066; F01D 5/3015
See application file for complete search history.

(56) References Cited

U.S. PATENT DOCUMENTS 2,656,147 A * 10/1953 Brownhill ..... F01D 5/084 416/193 A
3,094,309 A * 6/1963 Hull, Jr. ..... F01D 5/06 415/173.7
3,295,825 A * 1/1967 Hall, Jr. ..... F01D 5/06 415/173.7
4,127,359 A * 11/1978 Stephan ..... F01D 11/005 416/198 A
4,432,697 A * 2/1984 Miura ..... F01D 5/06 415/199.5
4,645,424 A * 2/1987 Peters ..... F01D 5/026 415/173.7
4,659,289 A * 4/1987 Kalogeros ..... F01D 5/3015 415/173.7
4,664,599 A * 5/1987 Robbins ..... F01D 5/066 416/198 A
5,236,302 A * 8/1993 Weisgerber ..... F01D 5/06 415/173.7
5,275,534 A * 1/1994 Cameron ..... F01D 11/006 416/220 R
5,288,210 A * 2/1994 Albrecht ..... F01D 5/066 416/198 A
5,842,831 A 12/1998 Galke et al.
6,416,276 B1 7/2002 Marmilic et al.
6,514,041 B1 2/2003 Matheny et al.
6,558,118 B1 * 5/2003 Brisson ..... F01D 11/003 415/173.7
7,101,144 B2 * 9/2006 Haje ..... F01D 5/084 415/115
7,722,319 B2 * 5/2010 Staempfli ..... F01D 5/08 29/888.025

(Continued)

FOREIGN PATENT DOCUMENTS

GB 1137630 12/1968

*Primary Examiner* — Igor Kershteyn
*Assistant Examiner* — Eldon Brockman
(74) *Attorney, Agent, or Firm* — James W. Pemrick; Ernest G. Cusick; Frank A. Landgraff

(57) ABSTRACT

A heat shield for a rotor in a turbine engine is provided. The heat shield includes a main body having a first pair of recesses. The first pair of recesses is adapted to fit around a portion of one or more rotor blades or between two axially adjacent rotor wheels. The first pair of recesses limits axial and radial movement of the heat shield by interaction with the rotor blades or by interaction with the two axially adjacent rotor wheels. The first pair of recesses engage axially adjacent rotor blades or the axially adjacent rotor wheels. The heat shield protects the rotor from hot gas.

13 Claims, 12 Drawing Sheets

(56) References Cited

U.S. PATENT DOCUMENTS

| | | | | |
|---|---|---|---|---|
| 8,007,230 | B2 | 8/2011 | Hafner | |
| 8,052,382 | B2 | 11/2011 | Konter et al. | |
| 8,221,062 | B2 * | 7/2012 | Liotta | F01D 5/066 415/173.7 |
| 8,376,689 | B2 * | 2/2013 | Bhagavatheeswaran | F01D 5/066 415/115 |
| 8,376,697 | B2 * | 2/2013 | Wiebe | F01D 11/001 415/173.7 |
| 2008/0181778 | A1 * | 7/2008 | Staempfli | F01D 5/08 416/204 R |
| 2010/0074730 | A1 * | 3/2010 | Liang | F01D 11/005 415/173.4 |
| 2010/0074731 | A1 * | 3/2010 | Wiebe | F01D 11/005 415/173.4 |
| 2010/0074732 | A1 * | 3/2010 | Marra | F01D 5/025 415/173.4 |
| 2010/0178160 | A1 * | 7/2010 | Liotta | F01D 5/066 415/173.7 |
| 2011/0255977 | A1 * | 10/2011 | Bhagavatheeswaran | F01D 5/066 416/198 A |
| 2013/0108413 | A1 * | 5/2013 | Suciu | F01D 11/006 415/115 |
| 2013/0264779 | A1 * | 10/2013 | Hafner | F01D 5/06 277/641 |

* cited by examiner

COMPRESSOR ROTOR HEAT SHIELD

BACKGROUND OF THE INVENTION

The present application relates generally to gas turbine engines and more particularly relates to a rotor heat shield for a compressor rotor in a gas turbine engine.

A compressor wheel assembly of known gas turbine engines generally includes a number of axially spaced rows of compressor blades separated by rows of stationary compressor vanes and the like. Gas turbine engine efficiency and part life may be related in part to the ability to shield effectively the rim area of the compressor wheels and other elements. A seal may be used to minimize the exposure of the compressor wheel to the hot compressed air and also to minimize the leakage of air that is used to cool various parts of the gas turbine. Due to the harsh, high temperature environment in which the seals are positioned, however, the seals may be susceptible to buckling and other types of deformation or damage. Moreover, known seals may be difficult and/or time consuming to install and/or replace.

BRIEF DESCRIPTION OF THE INVENTION

In an aspect of the present invention, a heat shield for a rotor in a turbine engine is provided. The heat shield includes a main body having a first pair of recesses. The first pair of recesses is adapted to fit around a portion of one or more rotor blades or between two axially adjacent rotor wheels. The first pair of recesses limits axial and radial movement of the heat shield by interaction with the rotor blades or by interaction with the two axially adjacent rotor wheels. The first pair of recesses engage axially adjacent rotor blades or the axially adjacent rotor wheels. The heat shield protects the rotor from hot gas.

In another aspect of the present invention, a compressor for a gas turbine is provided. The compressor includes a rotor having a plurality of rotor wheels and each rotor wheel has a plurality of rotor blades. The compressor also includes a heat shield having a main body. The main body has a first pair of recesses adapted to fit around a portion of one or more rotor blades or between two axially adjacent rotor wheels. The first pair of recesses limit axial and radial movement of the heat shield by interaction with the rotor blades or by interaction with the two axially adjacent rotor wheels. The first pair of recesses engage axially adjacent rotor blades or the axially adjacent rotor wheels. The heat shield protects the rotor from hot gas.

DETAILED DESCRIPTION OF THE INVENTION

One or more specific aspects/embodiments of the present invention will be described below. In an effort to provide a concise description of these aspects/embodiments, all features of an actual implementation may not be described in the specification. It should be appreciated that in the development of any such actual implementation, as in any engineering or design project, numerous implementation-specific decisions must be made to achieve the developers' specific goals, such as compliance with machine-related, system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "one aspect" or "an embodiment" or "an aspect" of the present invention are not intended to be interpreted as excluding the existence of additional embodiments or aspects that also incorporate the recited features.

Figure 1:
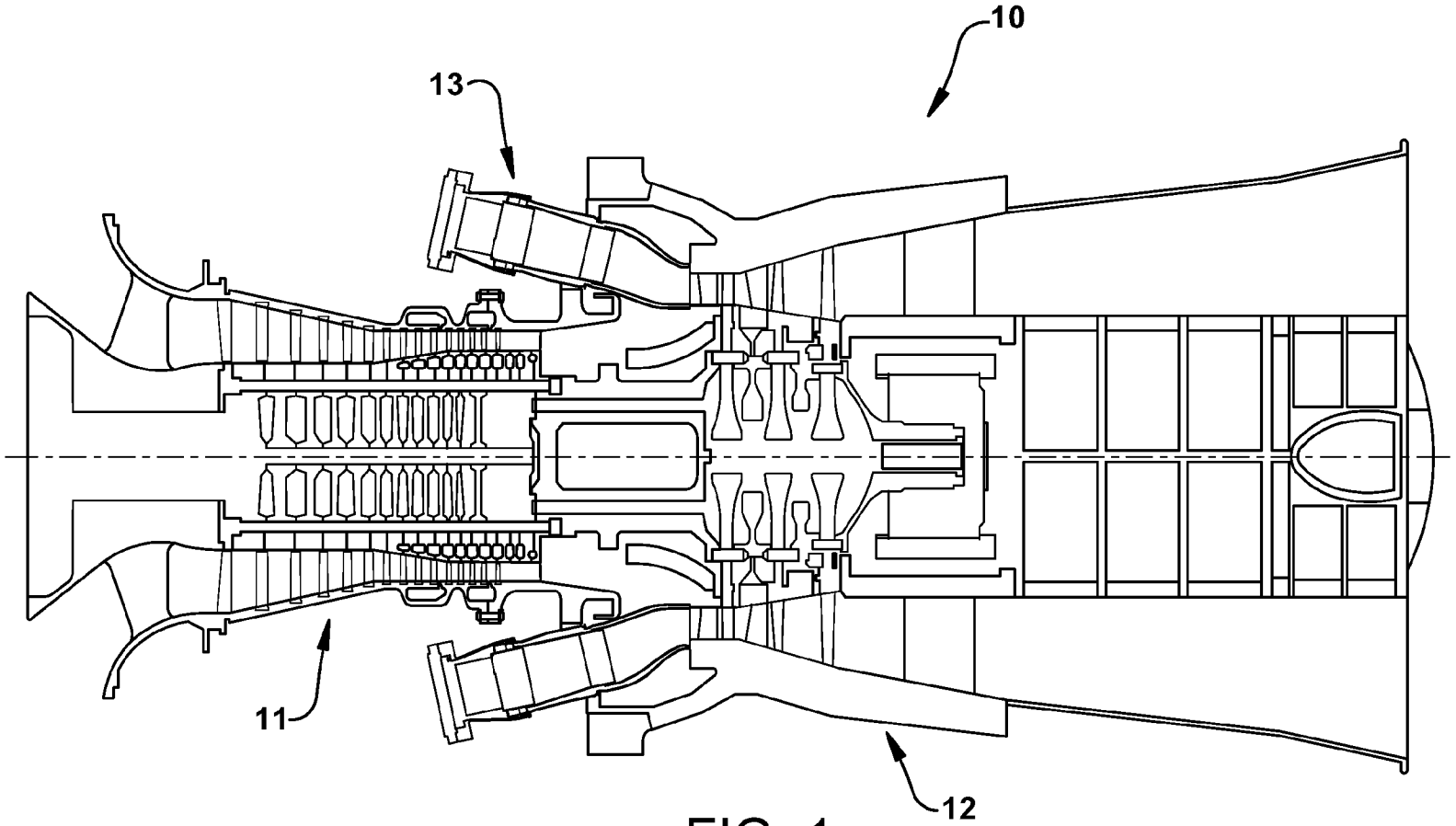
FIG. 1 is a schematic illustration of a gas turbine engine.
Figure 2:
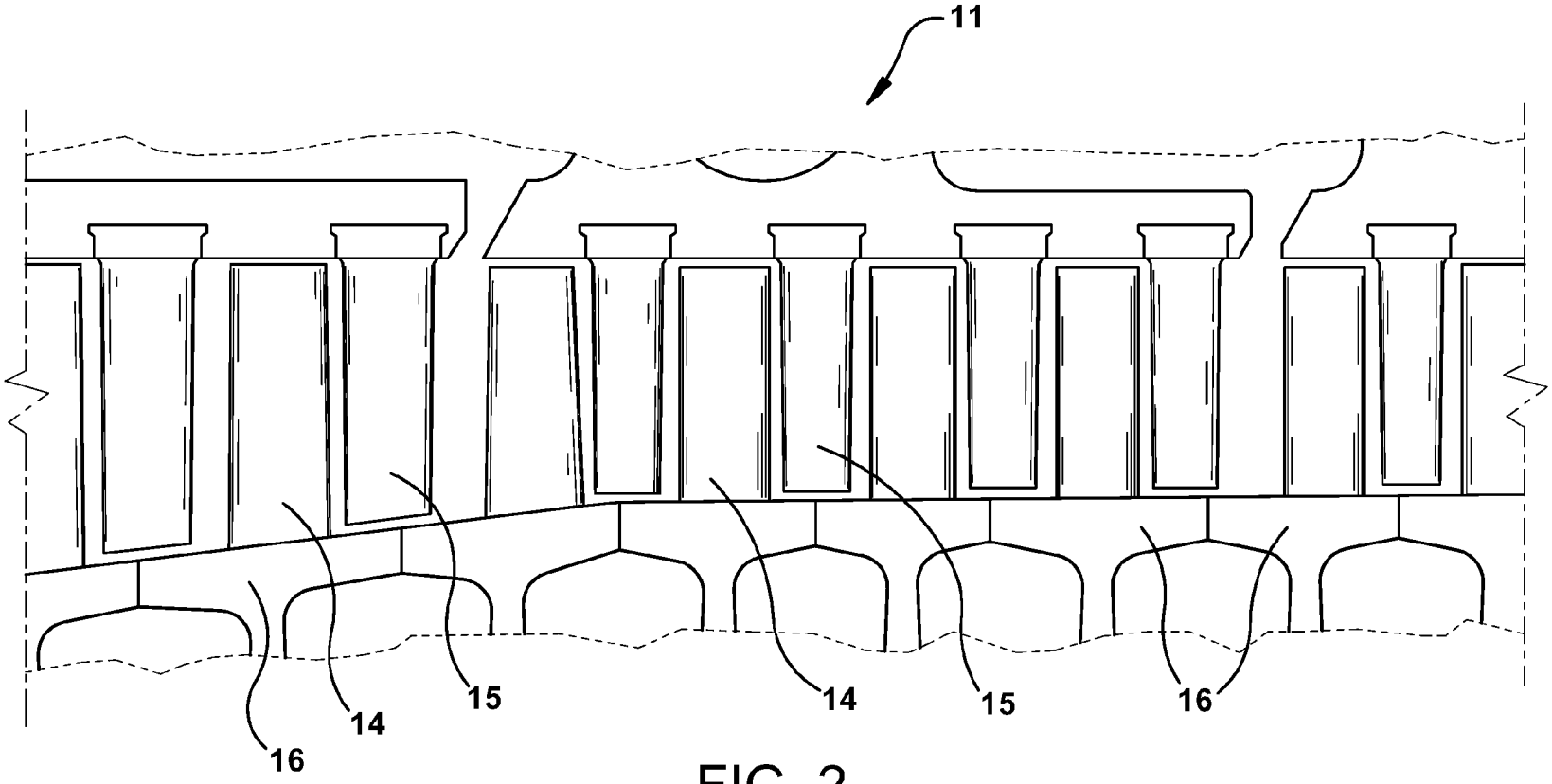
FIG. 2 illustrates a view of an exemplary multi-staged axial compressor that may be used in the gas turbine engine of FIG. 1.

Referring now to the figures, FIGS. 1 and 2 illustrate an exemplary gas turbine engine in which embodiments of the present application may be used. It will be understood by those skilled in the art that the present invention is not limited to this type of usage. As stated, the present invention may be used in gas turbine engines, such as the engines used in power generation and airplanes, steam turbine engines, and other type of rotary engines. FIG. 1 is a schematic representation of a gas turbine engine 10. In general, gas turbine engines operate by extracting energy from a pressurized flow of hot gas produced by the combustion of a fuel in a stream of compressed air. As illustrated in FIG. 1, gas turbine engine 10 may be configured with an axial compressor 11 that is mechanically coupled by a common shaft or rotor to a downstream turbine section or turbine 12. A combustor 13 is positioned between the compressor 11 and the turbine 12.

FIG. 2 illustrates a view of an exemplary multi-staged axial compressor 11 that may be used in the gas turbine engine 10 of FIG. 1. As shown, the compressor 11 may include a plurality of stages. Each stage may include a row of compressor rotor blades 14 followed by a row of compressor stator blades or vanes 15. Thus, a first stage may include a row of compressor rotor blades 14, which rotate about a central shaft, followed by a row of compressor stator vanes 15, which remain stationary during operation. The compressor stator vanes 15 generally are circumferentially spaced one from the other and fixed about the axis of rotation. The compressor rotor blades 14 are circumferentially spaced and attached to rotor wheels 16, and the rotor wheels are attached to the shaft; when the shaft rotates during operation, the compressor rotor blades 14 rotate about it. As one of ordinary skill in the art will appreciate, the compressor rotor blades 14 are configured such that, when spun about the shaft, they impart kinetic energy to the air or fluid flowing through the compressor 11. The compressor 11 may have other stages beyond the stages that are illustrated in FIG. 2. Additional stages may include a plurality of circumferential spaced compressor rotor blades 14 followed by a plurality of circumferentially spaced compressor stator blades 15.

Figure 3:
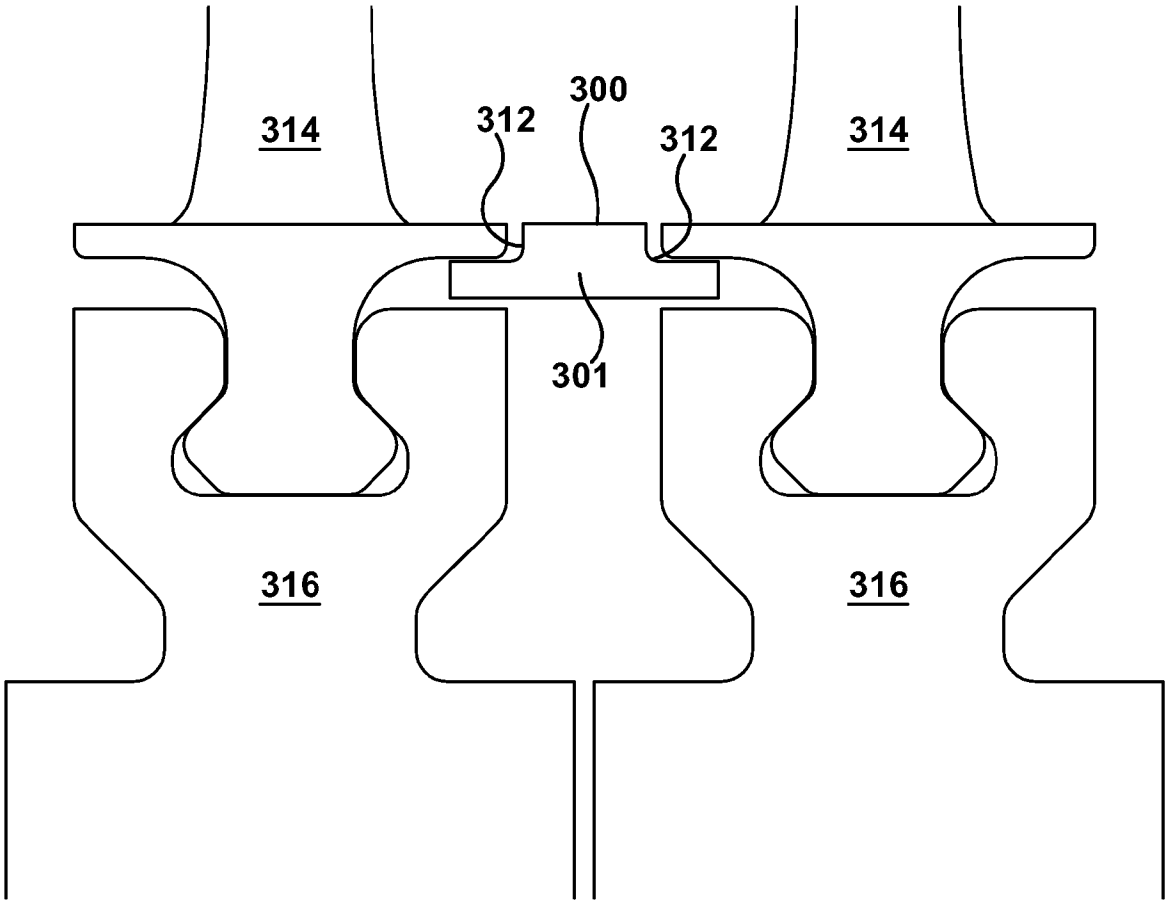
FIG. 3 illustrates a simplified cross-sectional view of a heat shield installed between two axially adjacent rotor blades, according to an aspect of the present invention

FIG. 3 illustrates a simplified cross-sectional view of a heat shield 300 installed between two axially adjacent rotor blades 314, according to an aspect of the present invention. The heat shield 300 includes a main body 301 having a first pair of recesses 312. The first pair of recesses 312 are adapted to fit around a portion the rotor blades 314. The first pair of recesses 312 limit axial and radial movement of the heat shield 300 by interaction with the rotor blades 314, because the first pair of recesses 312 engage axially adjacent rotor blades 314. Each of the first pair of recesses 312 are formed by a step-shaped recess, however, any other suitable shape could be used as desired in the specific application. The rotor blades 314 are retained by grooves within the rotor wheels 316. It can be seen that the heat shield 300 is axially and radially retained on the rotor by engagement (or connection), via recesses 312 to the rotor blades 314, and without connection of the heat shield 300 to the rotor wheels 316. The heat shield 300 protects the rotor (including the rotor wheels 316) from hot gas. In a compressor of a gas turbine, the hot air (or gas) passing axially through the stages becomes increasingly hotter as the compression increases. The temperature of the hot gas (e.g., air) can elevate to a point where damage may occur to the rotor or rotor wheels 316. The heat shield 300 is preferably formed of temperature resistant materials, such as a nickel alloy (e.g., Inconel 718) or high grade titanium alloys that resist damage by the hot gas and temperatures experienced in compressors. However, any suitable temperature resistant material could be used as desired in the specific application. The operating life of the turbine (and compressor) can be increased, while the maintenance frequency may be decreased due to incorporation of the heat shield 300. Alternatively, lower cost materials, such as steel, can be used in the rotor construction at higher gas temperatures or compression ratios.

Figure 4:
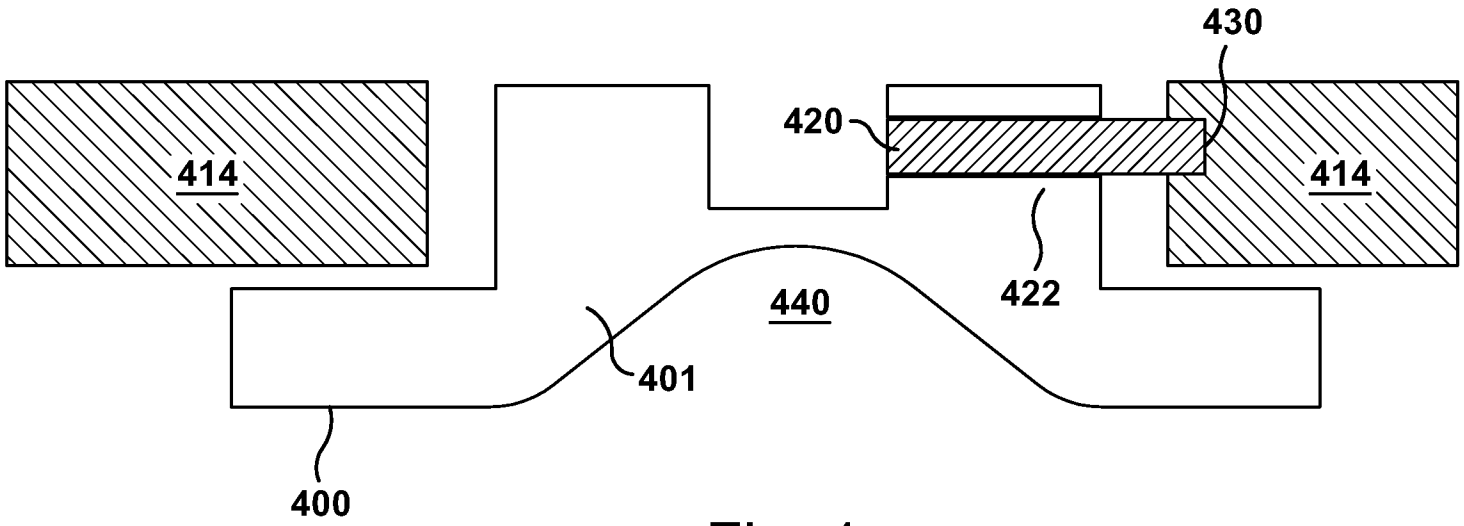
FIG. 4 illustrates a simplified cross-sectional view of a heat shield installed between two rotor blades, according to an aspect of the present invention.
Figure 5:
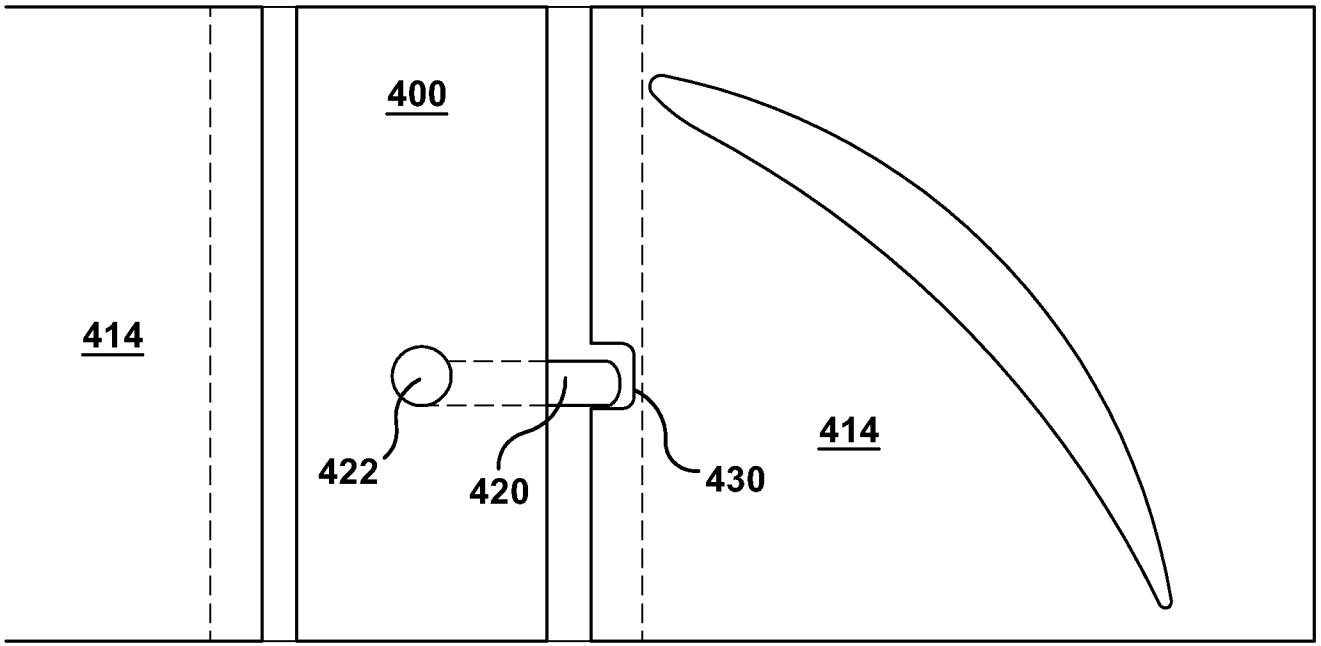
FIG. 5 illustrates a simplified top view of a heat shield installed between two rotor blades, according to an aspect of the present invention.

FIG. 4 illustrates a simplified cross-sectional view of a heat shield 400 installed between two rotor blades 414, according to an aspect of the present invention. The heat shield 400 includes a pin 420 adapted to fit in a hole 422 in the main body 401. The pin 420 is adapted to be driven into a rotor blade recess 430. The rotor blade recess may be located in a platform section of the rotor blade 414. The pin 420, when inserted into the rotor blade recess 430 locks the heat shield to the rotor blade 414 and limits or prevents relative rotation between the rotor blade recess 430 (and rotor blade 414) and the heat shield 400. The pin 420 and through hole 422 may be formed in each individual heat shield or only a subset of the heat shield circumferentially disposed around the rotor. For example, every other heat shield may contain a pin 420 locking mechanism, or a pin locking mechanism may be provided in one heat shield per quarter of the rotor stage. The heat shield's 400 main body 401 may also include a concave section 440 formed in a radially inward facing surface. The concave section 440 is configured to reduce weight of the heat shield 400. FIG. 5 illustrates a top view of the pin 420 partially inserted within the rotor blade recess 430. The pin 420 may be mechanically held in place by staking, may be threaded, use locking threads, or any other suitable retaining structure or method. In the embodiments of FIGS. 3-5 the heat shield 300 is centrifugally and axially captured by the rotor blades 314.

Figure 6:
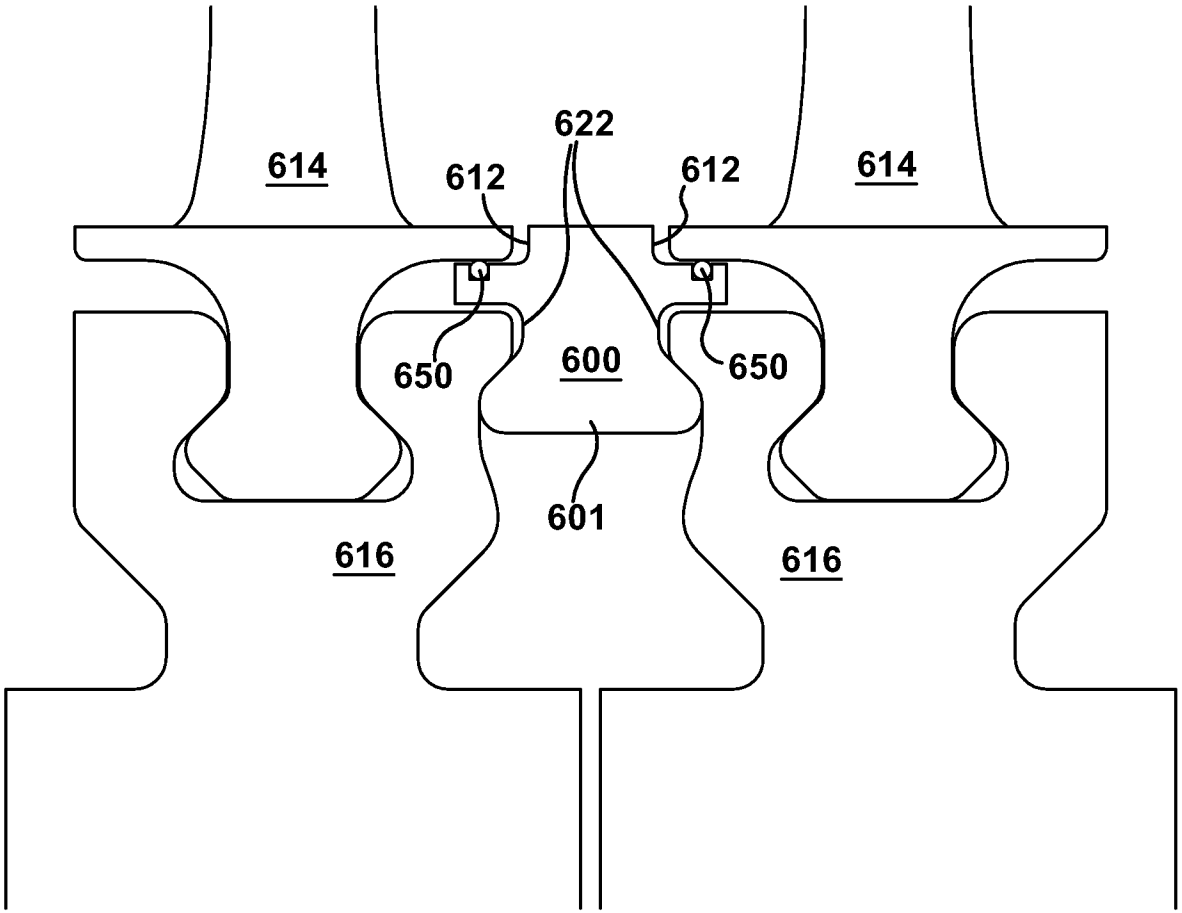
FIG. 6 illustrates a simplified cross-sectional view of a heat shield installed between two axially adjacent rotor blades and wheels, according to an aspect of the present invention.

FIG. 6 illustrates a simplified cross-sectional view of a heat shield 600 installed between two axially adjacent rotor wheels 616, according to an aspect of the present invention. The rotor wheels 616 retain the heat shields 600 in this embodiment. The heat shield 600 includes a main body 601 having a first pair of recesses 612 adapted to fit around a portion the rotor blades 614. The first pair of recesses 612 may limit axial and radial movement of the heat shield 600 by interaction with the rotor blades 614, because the first pair of recesses 612 engage axially adjacent rotor blades 614. Each of the first pair of recesses 612 may be formed by a step-shaped recess, however, any other suitable shape could be used as desired in the specific application. The rotor blades 614 are retained by grooves within the rotor wheels 616.

The heat shield 600 also includes a second pair of recesses, each of the second pair of recesses 622 formed in the main body 601 and to coincide with the neck region between the two rotor wheels 616. In can be seen that the second pair of recesses 622 are adapted to engage portions of the rotor wheels 616, and both recesses 622 are configured to engage axially adjacent rotor wheels 616. The second pair of recesses 622 limit axial and radial movement of the heat shield 600 by interaction with the adjacent rotor wheels 614. The axial direction would be left and right, while the radial direction would be up and down in FIG. 6. It is to be understood that the main radial force would be in the "up" (or radially outward) direction due to centrifugal forces during operation of the turbine. The second pair of recesses 622 may be comprised of a dovetail shaped or hook shaped recess on each side of the main body 601.

It can be seen that the heat shield 600 is axially and radially retained on the rotor by engagement (or connection), via recesses 622 to the rotor wheels 616. An advantage to this arrangement is that the wheels carry the load of the heat shield instead of the less structurally capable blade overhangs or platforms. The heat shield 600 may also include one or more seal wires 650 disposed on the first pair of recesses 612 and the seal wires are configured to limit gas flow between the rotor blades 614 and heat shield 600. The heat shield 600 protects the rotor (including the rotor wheels 616) from hot gas, and may be made of high-temperature resistant materials.

Figure 7:
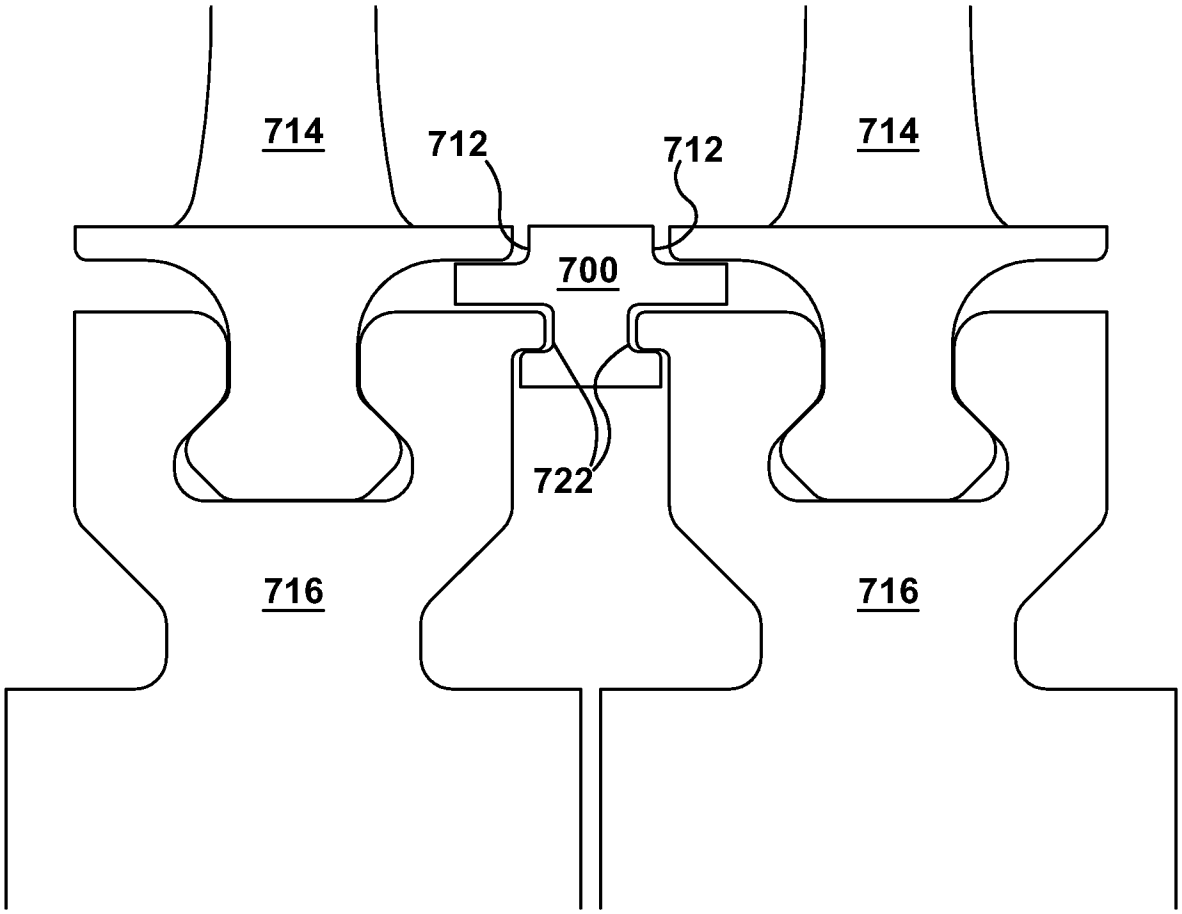
FIG. 7 illustrates a simplified cross-sectional view of a heat shield installed between two axially adjacent rotor blades and wheels, according to an aspect of the present invention.

FIG. 7 illustrates a simplified cross-sectional view of a heat shield 700 installed between two axially adjacent rotor wheels 716, according to an aspect of the present invention. The heat shield 700 includes a main body 701 having a first pair of recesses 712 adapted to fit around a portion the rotor blades 714. The main body 701 also includes a second pair of recesses 722 that are hook shaped. The first pair of recesses 712 may limit axial and radial movement of the heat shield 600 by interaction with the axially adjacent rotor blades 714, and the second pair of recesses 722 limit axial and radial movement of the heat shield 700 by interaction with the axially adjacent rotor wheels 716.

Figure 8:
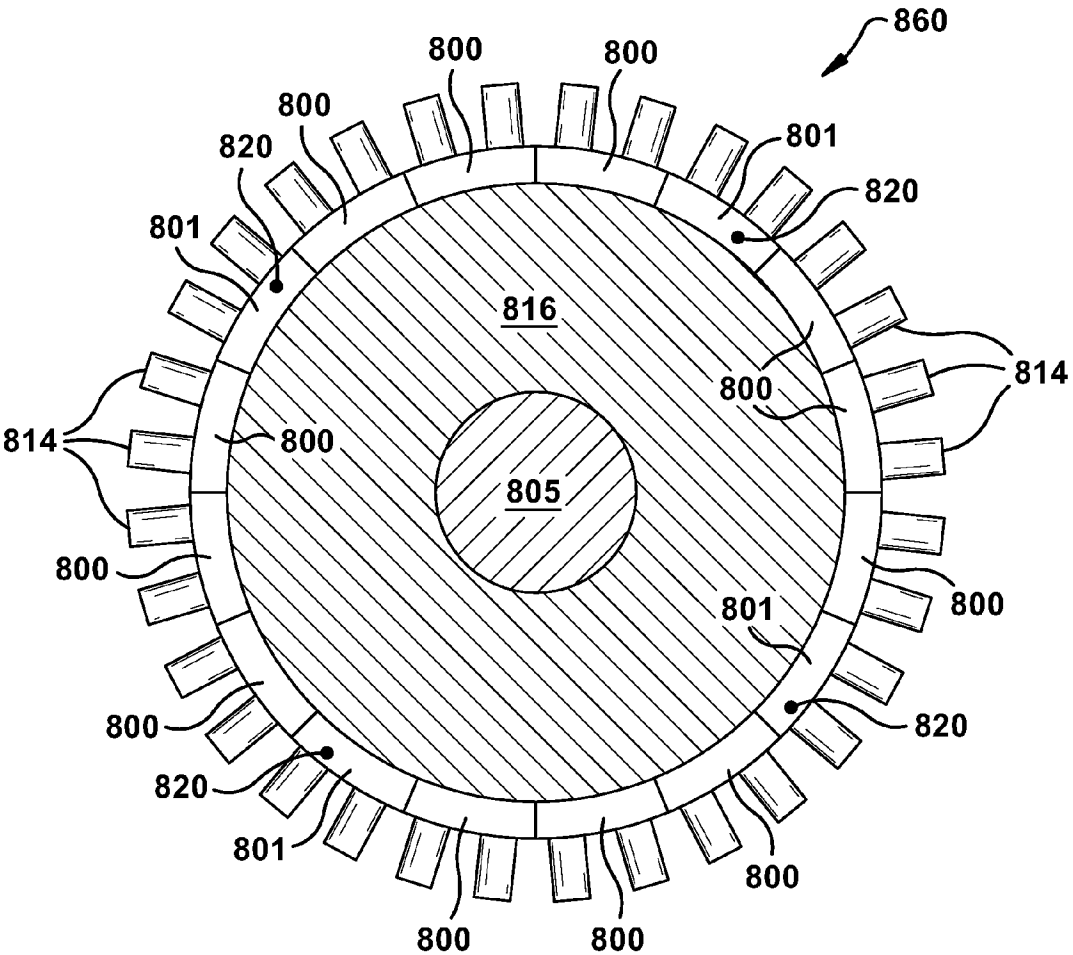
FIG. 8 illustrates a simplified axial cross sectional view of a compressor rotor, according to an aspect of the present invention.

FIG. 8 illustrates a simplified axial cross sectional view of a compressor rotor showing the heat shields 800, 801 circumferentially disposed around the compressor rotor. The compressor 860 includes rotor wheel 816 connected to a central shaft 805. The rotor may include the shaft 805, rotor wheels 816 and rotor blades 814. The rotor blades 814 are circumferentially disposed around the rotor. In addition, the heat shield segments 800, 801 are also circumferentially disposed around the rotor. Heat shield segments 801 include a pin 820 that prevents relative circumferential motion between the shield and the blade. The pin fits into a rotor blade recess and this locking arrangement prevents relative rotation between the heat shield segments 800, 801 and the rotor blades 814. As shown in FIG. 8, the locking pins 820 may be provided in one heat shield in each quarter of the rotor stage, and the heat shield segments 801 include the pins 820. However, it is to be understood that one or more pins could be provided in each stage as desired in the specific application.

Figure 9:
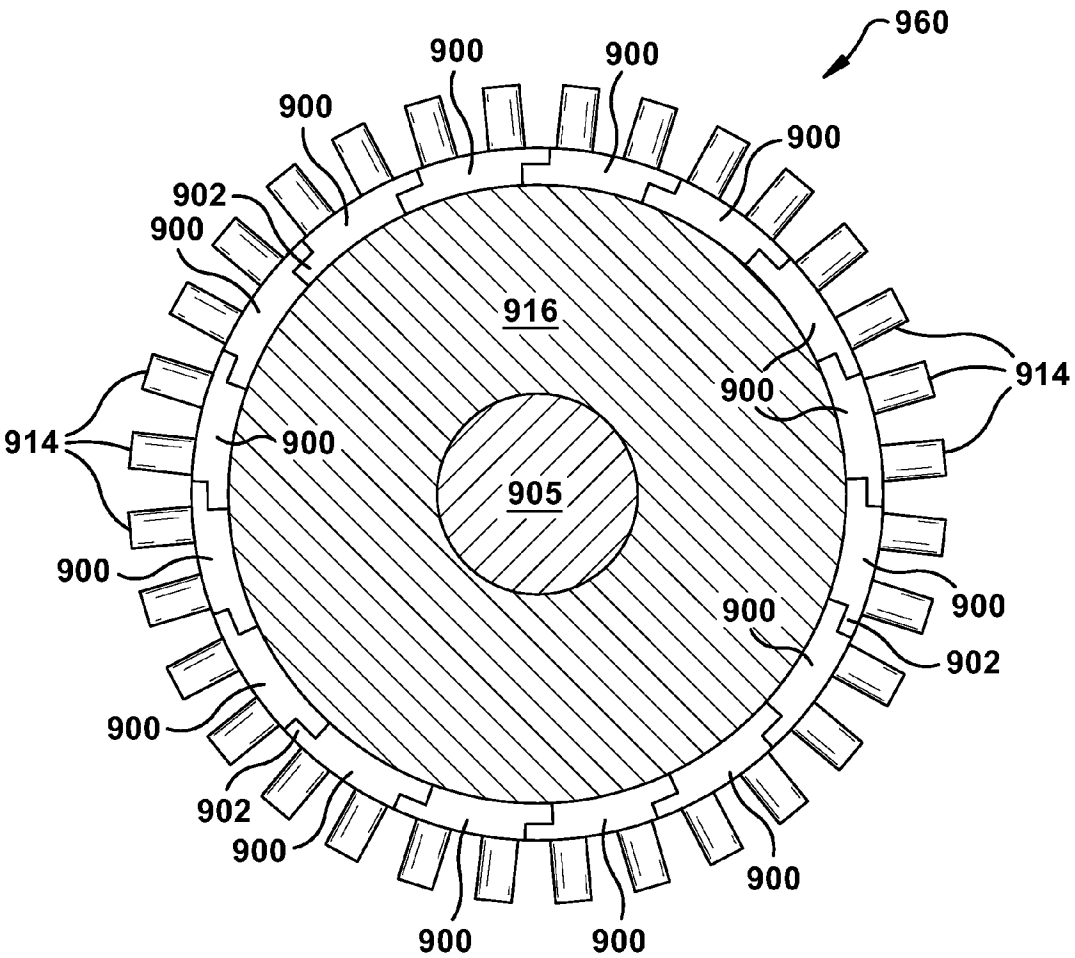
FIG. 9 illustrates a simplified axial cross sectional view of a compressor rotor, according to an aspect of the present invention.

FIG. 9 illustrates a simplified axial cross sectional view of a compressor rotor showing the heat shields 900 circumferentially disposed around the compressor rotor. The compressor 960 includes rotor wheel 916 connected to a central shaft 905. The rotor may include the shaft 905, rotor wheels 916 and rotor blades 914. The rotor blades 914 are circumferentially disposed around the rotor. In addition, the heat shield segments 900, are also circumferentially disposed around the rotor. Some of the heat shield segments 900 may include a pin (not shown) that prevents relative circumferential motion between the shield and the rotor blade. The heat shields 900 may be configured to have a shiplap section 902 at each end that overlaps adjacent heat shields. The shiplap section 902 (i.e, stepped overlap) at the ends may further reduce leakage between the heat shield ends.

Figure 10:
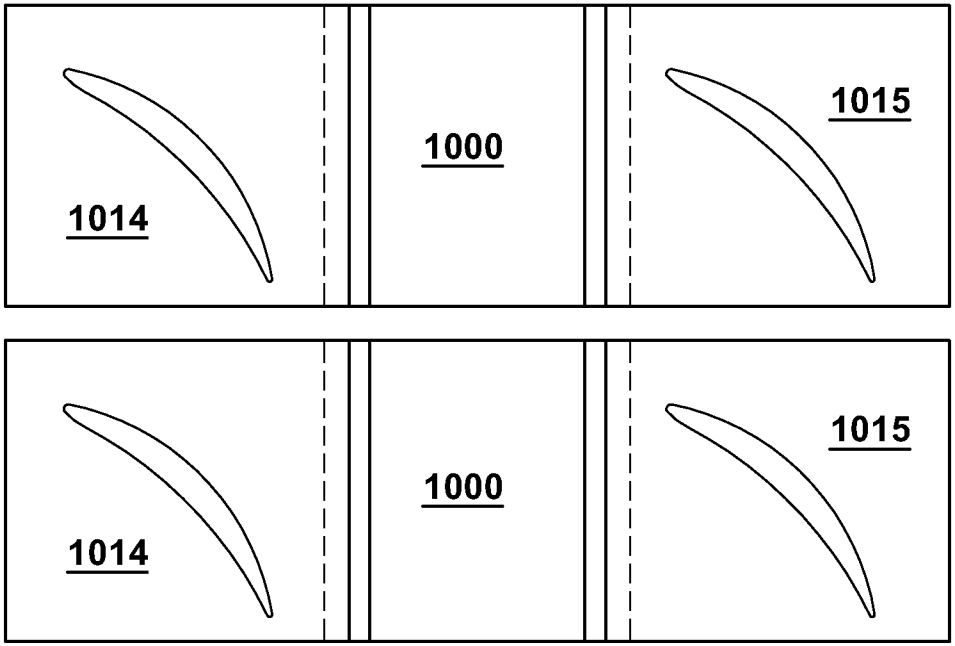
FIG. 10 illustrates a top view of two heat shields installed between a first stage of rotor blades and a subsequent and axially adjacent set of rotor blades, according to an aspect of the present invention.

FIG. 10 illustrates a top view of two heat shields 1000 installed between a first stage of rotor blades 1014 and a subsequent and axially adjacent set of rotor blades 1015, according to an aspect of the present invention. In this example, one heat shield 1000 is sized to fit between two axially adjacent rotor blades 1014, 1015 and the circumferential length of the rotor blades 1014, 1015 and heat shield 1000 is generally equal.

Figure 11:
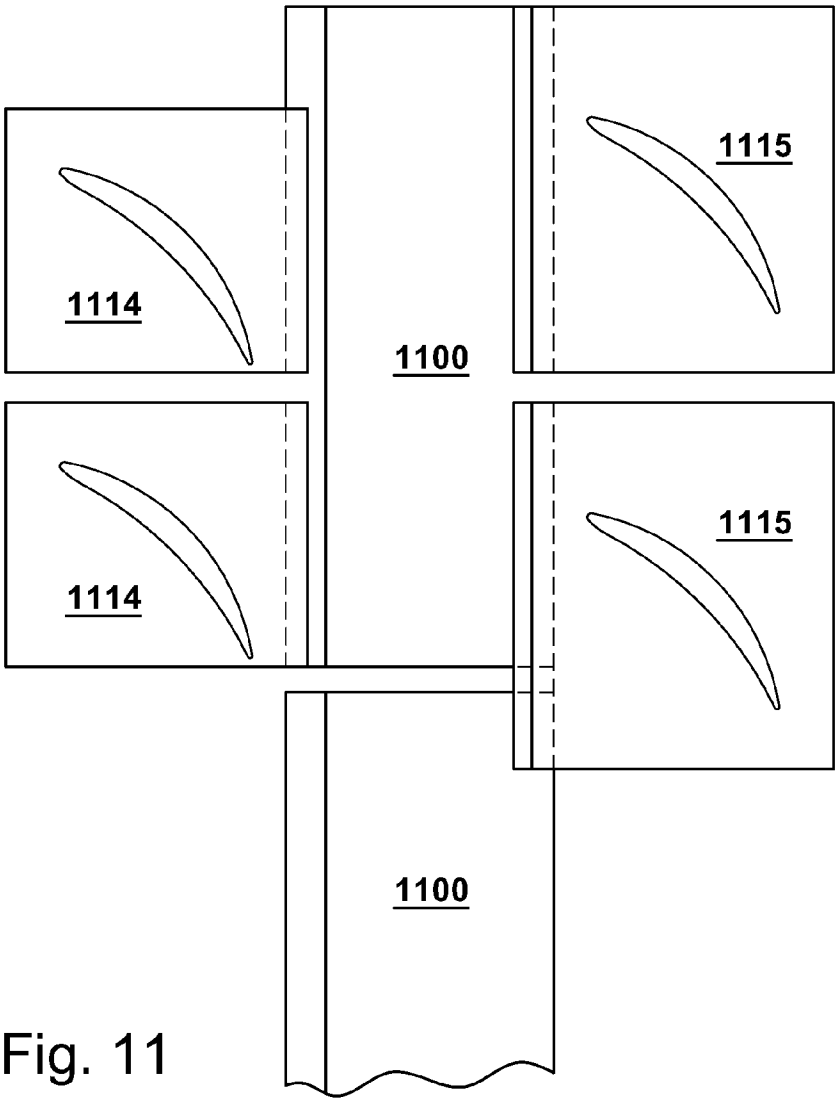
FIG. 11 illustrates a top view of a heat shield installed between a first stage of rotor blades and a subsequent and axially adjacent set of rotor blades, according to an aspect of the present invention.

FIG. 11 illustrates a top view of a heat shield 1100 installed between a first stage of rotor blades 1114 and a subsequent and axially adjacent set of rotor blades 1115, according to an aspect of the present invention. In this example, one heat shield 1100 circumferentially spans two or more axially adjacent rotor blades 1114, 1115. It can be seen that the circumferential length of the rotor blades 1114, 1115 is less than the circumferential length of the heat shield 1100.

Figure 12:
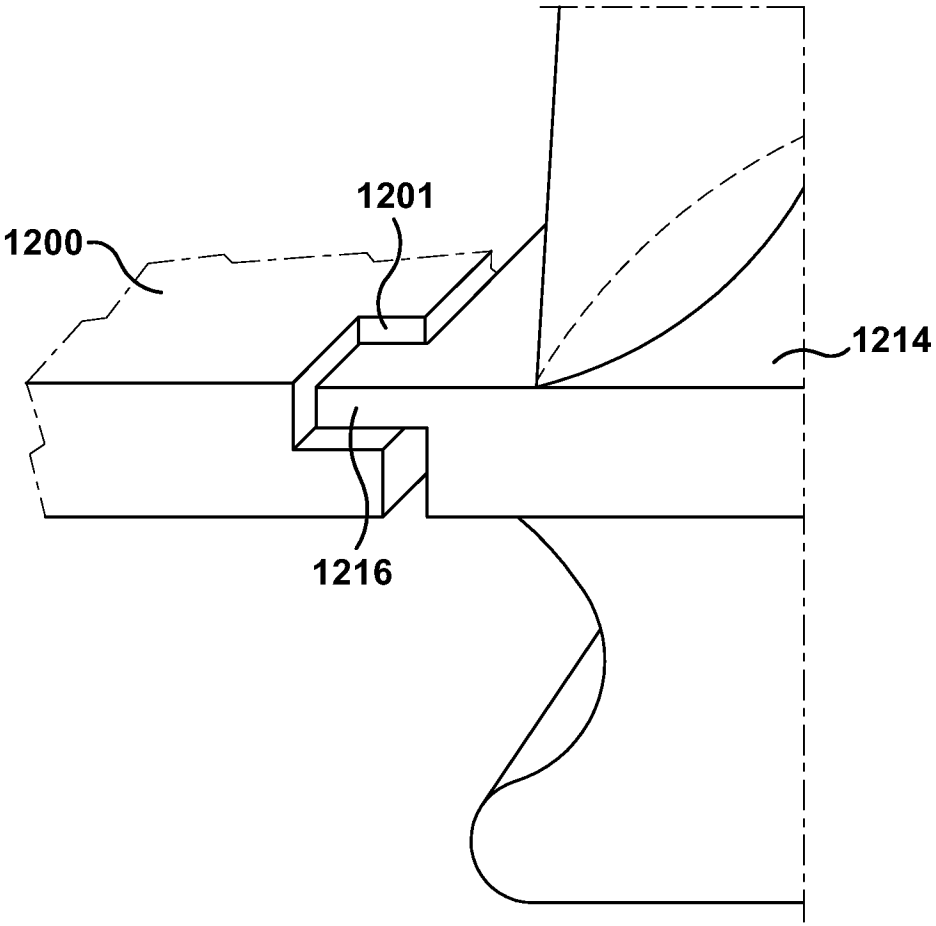
FIG. 12 illustrates a partial cross-sectional and perspective illustration of a heat shield installed next to a rotor blade having a tab/notch arrangement to limit relative circumferential motion between the heat shield and the rotor blades, according to an aspect of the present invention.

FIG. 12 illustrates a partial cross-sectional and perspective illustration of a heat shield 1200 installed next to a rotor blade 1214. The heat shield 1200 has a notch 1201 that is sized to engage a raised portion 1216 or tab on rotor blade 1214. Alternatively, the notch could be formed on the rotor blade and the tab could be formed on the heat shield. This tab/notch interaction limits or prevents relative circumferential motion between the heat shield and the rotor blades.

One advantage provided by the use of the heat shields herein described is that the rotor of the compressor may be formed by a wider variety of materials, because the heat shield protects the rotor from hot air or hot gas passing through the compressor. Another advantage the heat shield provides is that the turbine maintenance interval may be decreased (i.e., less frequent maintenance outages) while turbine operating lifetime may be increased.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A heat shield for a rotor in a turbine engine, the heat shield comprising:

a main body having a first pair of recesses, the first pair of recesses adapted to fit around a portion of one or more rotor blades, the first pair of recesses limiting axial and radial movement of the heat shield by interaction with the rotor blades, the first pair of recesses engaging axially adjacent rotor blades; and wherein the heat shield protects the rotor from hot gas, and the heat shield is retained on the rotor by engagement or connection to a rotor blade and without connection of the heat shield to a rotor wheel.

2. The heat shield of claim 1, the heat shield further comprising:

a pin adapted to fit in a hole of the main body; the pin adapted to be driven into a rotor blade recess;

wherein the pin limits relative rotation between the rotor blade recess and the heat shield.

3. The heat shield of claim 1, further comprising:

one or more seal wires disposed on the first pair of recesses, the seal wires configured to limit gas flow between the rotor blades and the heat shield.

4. The heat shield of claim 1, wherein the heat shield is comprised of a plurality of heat shield segments circumferentially disposed around the rotor of a compressor.

5. The heat shield of claim 1, further comprising a concave section formed in a radially inward facing surface of the main body, the concave section configured to reduce weight of the heat shield.

6. The heat shield of claim 1, further comprising a shiplap section located at each end of the heat shield, the shiplap section configured to overlap an adjacent heat shield, and wherein the shiplap section is configured to reduce leakage between the end of the heat shield.

7. The heat shield of claim 1, the heat shield further comprising at least one of a heat shield tab or a heat shield notch configured to engage a rotor blade notch or a rotor blade tab, respectively;

wherein tab/notch interaction limits relative circumferential motion between the heat shield and the one or more rotor blades.

8. A compressor for a gas turbine, the compressor comprising a rotor having a plurality of rotor wheels and each rotor wheel having a plurality of rotor blades, the compressor comprising:

a heat shield having a main body, the main body having a first pair of recesses, the first pair of recesses adapted to fit around a portion of one or more rotor blades, the first pair of recesses limiting axial and radial movement of the heat shield by interaction with the rotor blades, the first pair of recesses engaging axially adjacent rotor blades; and wherein the heat shield protects the rotor from hot gas, and the heat shield is retained on the rotor by engagement with, or connection to, the rotor blade and without connection of the heat shield to the rotor wheel.

9. The compressor of claim 8, further comprising at least one of:

one or more seal wires disposed on the first pair of recesses, the seal wires configured to limit gas flow between the rotor blades and the heat shield, or a shiplap section located at each end of the heat shield, the shiplap section configured to overlap an adjacent heat shield, and wherein the shiplap section is configured to reduce leakage between the end of the heat shield.

10. The compressor of claim 8, the heat shield further comprising:

a pin adapted to fit in a hole of the main body; the pin adapted to be driven into a rotor blade recess; and wherein the pin limits relative rotation between the rotor blade recess and the heat shield.

11. The compressor of claim 8, wherein the heat shield is comprised of a plurality of heat shield segments circumferentially disposed around the rotor.

12. The compressor of claim 8, further comprising a concave section formed in a radially inward facing surface of the main body, the concave section configured to reduce weight of the heat shield.

13. The compressor of claim 8, the heat shield further comprising at least one of a heat shield tab or a heat shield notch configured to engage a rotor blade notch or a rotor blade tab, respectively;

wherein tab/notch interaction limits relative circumferential motion between the heat shield and the one or more rotor blades.

* * * * *